US011133599B2

(12) United States Patent
Liu

(10) Patent No.: US 11,133,599 B2
(45) Date of Patent: Sep. 28, 2021

(54) PHASED ARRAY ANTENNA

(71) Applicant: AAC Technologies Pte. Ltd., Singapore (SG)

(72) Inventor: Mao Liu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 56 days.

(21) Appl. No.: 16/702,507

(22) Filed: Dec. 3, 2019

(65) Prior Publication Data

US 2020/0212592 A1 Jul. 2, 2020

(30) Foreign Application Priority Data

Dec. 28, 2018 (CN) ..... 201811624478.6

(51) Int. Cl.

| | |
|---|---|
| ***H01Q 21/00*** | (2006.01) |
| ***H01Q 21/22*** | (2006.01) |
| ***H01Q 1/48*** | (2006.01) |
| ***H01Q 1/00*** | (2006.01) |
| ***H01Q 1/24*** | (2006.01) |
| ***H01Q 3/36*** | (2006.01) |

(52) U.S. Cl.

CPC ..... *H01Q 21/0025* (2013.01); *H01Q 1/007* (2013.01); *H01Q 1/246* (2013.01); *H01Q 1/48* (2013.01); *H01Q 3/36* (2013.01); *H01Q 21/22* (2013.01)

(58) Field of Classification Search

CPC ..... H01Q 21/0025; H01Q 21/065; H01Q 1/2283; H01Q 21/061

See application file for complete search history.

(56) References Cited

U.S. PATENT DOCUMENTS

2015/0015453 A1* 1/2015 Puzella ..... H05K 1/0206 343/853
2018/0159203 A1* 6/2018 Baks ..... H01Q 1/2283

FOREIGN PATENT DOCUMENTS

CN 105305075 A1 2/2016

OTHER PUBLICATIONS

PCT search report dated Feb. 3, 2020 by SIPO in related PCT Patent Application No. PCT/CN2019/113304(9 Pages).

* cited by examiner

*Primary Examiner* — Ricardo I Magallanes
(74) *Attorney, Agent, or Firm* — W&G Law Group

(57) ABSTRACT

The invention provides a phased array antenna, which includes a core board, as well as an antenna module and a radio frequency module respectively arranged at two sides of the core board, where the radio frequency module includes a device attached to a surface far away from the core board and a circuit layer electrically connected to the device, and the device and the circuit layer at least form a phase control unit to control a phase of each antenna unit in the antenna module and a beam synthesis unit to control a beam shape of the phased array antenna.

8 Claims, 17 Drawing Sheets

PHASED ARRAY ANTENNA

TECHNICAL FIELD

The present disclosure relates to antenna technologies, and more particularly, to a phased array antenna.

BACKGROUND

The fifth generation communication technology (5G) is committed to building an ecosystem of information and communication technologies, and is one of the hottest topics in the industry at present. Different from the previous 2G, 3G and 4G, 5G is not only the upgrading of mobile communication technology, but also the driving platform of the future digital world and the infrastructure for the development of the Internet of Things, which will truly create a new era of full connectivity.

However, with the development of 5G technology, the existing millimeter wave antenna has been difficult to meet the requirements of an indoor base station.

BRIEF DESCRIPTION OF THE DRAWINGS

In order to illustrate the technical solutions in the embodiments of the present disclosure more clearly, the drawings used in the description of the embodiments will be briefly described below. It is evident that the drawings in the following description are merely some embodiments of the present disclosure. Those of ordinary skills in the art can also obtain other drawings according to these drawings without any creative work, where.

DETAILED DESCRIPTION

The technical solutions in the embodiments of the present disclosure will be clearly and completely described with reference to the accompanying drawings in the present disclosure. It is evident that the embodiments described are only some rather than all embodiments in the present disclosure. Based on the embodiments of the present disclosure, all other embodiments obtained by those of ordinary skills in the art without any creative work shall fall within the scope of protection of the present disclosure.

Figure 1:
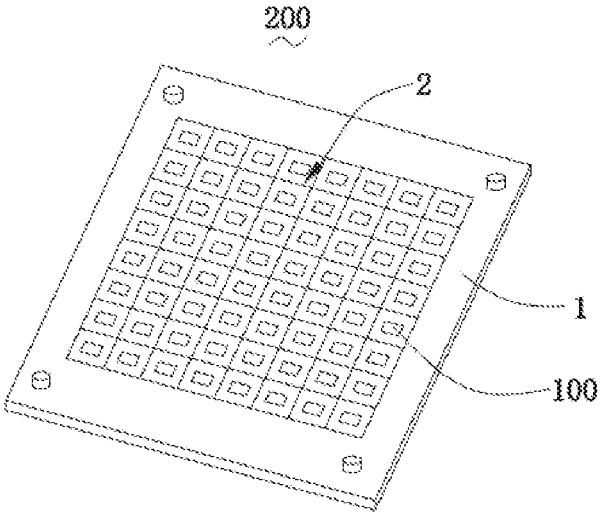
FIG. 1 is a perspective diagram from a first view of a phased array antenna provided in the present disclosure.
Figure 2:
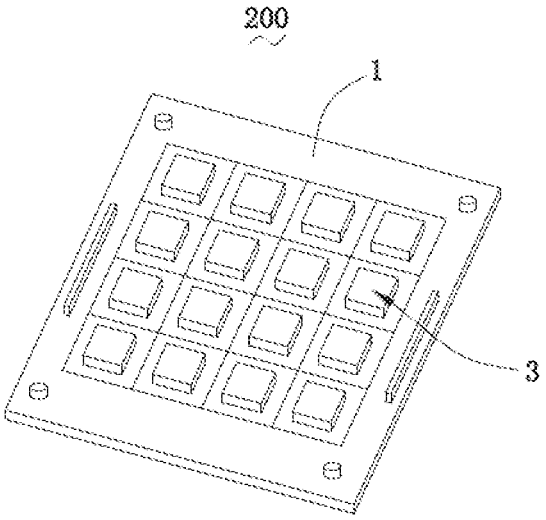
FIG. 2 is a perspective diagram from a second view of the phased array antenna provided in the present disclosure.
Figure 3:
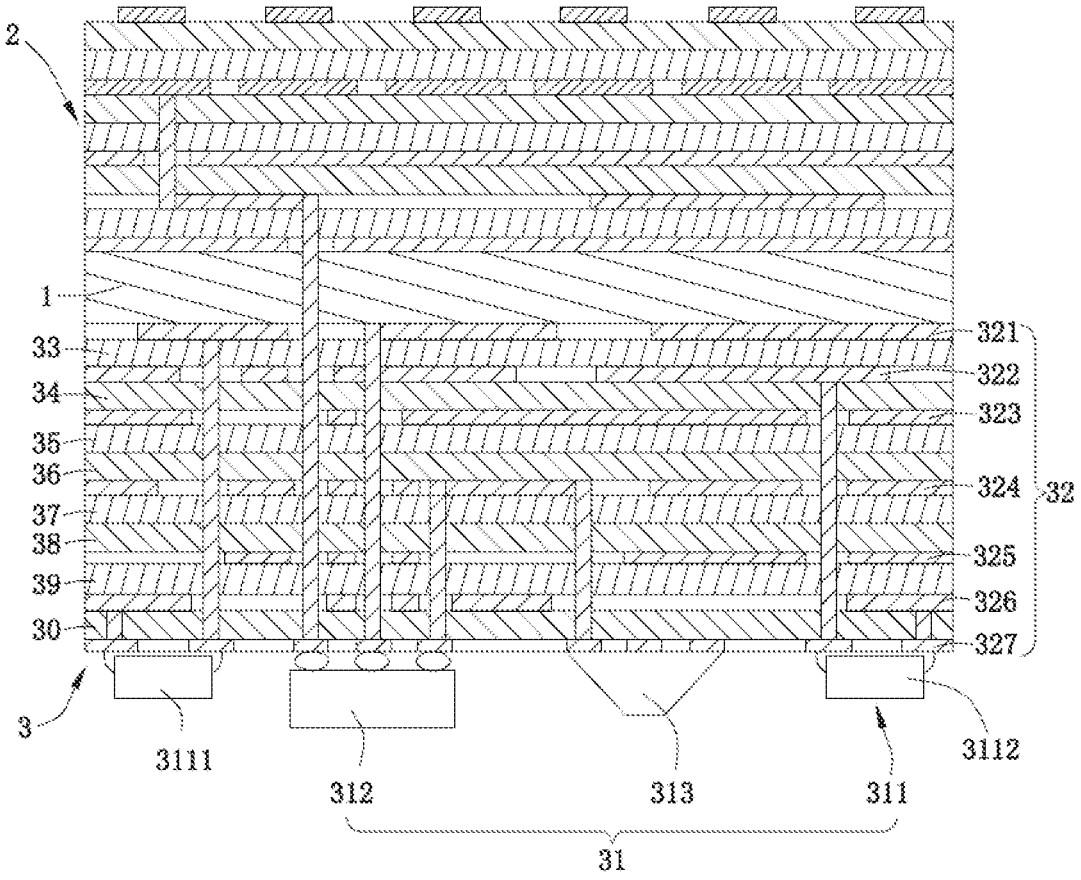
FIG. 3 is a sectional view diagram of a partial structure of the phased array antenna provided in the present disclosure.

With reference to FIG. 1 to FIG. 3, the embodiment of the present disclosure provides a phased array antenna 200, which includes a core board 1, as well as an antenna module 2 and a radio frequency module 3 respectively arranged at two sides of the core board 1. In the specific embodiment of the present disclosure, the core board 1 has a thickness of 0.3 mm. In other embodiments, the core board 1 has an adjustable thickness. The antenna module 2 includes a plurality of antenna units 100 arranged in an array.

The radio frequency module 3 includes a device 31 attached to a surface far away from the core board 1 and a circuit layer 32 electrically connected to the device 31. The device 31 and the circuit layer 32 at least form a phase control unit to control a phase of each antenna unit 100 in the antenna module 2 and a beam synthesis unit to control a beam shape of the phased array antenna 200.

The circuit layer 32 includes a control line layer 321, a power supply layer 322, a first combiner network ground layer 323, a combiner network layer 324, a second combiner network ground layer 325, a surface-attached device ground layer 326 and a surface-attached device layer 327 sequentially arranged at intervals from top to bottom. Preferably, the control line layer 321, the power supply layer 322, the first combiner network ground layer 323, the combiner network layer 324, the second combiner network ground layer 325, the surface-attached device ground layer 326 and the surface-attached device layer 327 are all copper layers.

The device 31 at least includes a storage unit 311, a RFIC chip 312 and a plug 313 which are arranged on the surface-attached device layer 327. The storage unit 311 includes a first storage unit 3111 and a second storage unit 3112. The first storage unit 3111, the RFIC chip 312 and the second storage unit 3112 are all electrically connected to the surface-attached device layer 327, the control line layer 321 and the surface-attached device ground layer 326 are both electrically connected to the first storage unit 3111 via the surface-attached device layer 327, the antenna module 2, the control line layer 321 and the combiner network layer 324 are electrically connected to the RFIC chip 312 respectively, the combiner network layer 324 is electrically connected to the plug 313, and the power supply layer 322 and the surface-attached device ground layer 326 are electrically connected to the second storage unit 3112 via the surface-attached device layer 327 respectively.

In a preferred embodiment of the present disclosure, the first storage unit 3111 and the second storage unit 3112 are both MLC (Multi-Level Cell).

The radio frequency module 3 further includes a first prepreg 33 sandwiched between the control line layer 321 and the power supply layer 322, a first dielectric layer 34 sandwiched between the power supply layer 322 and the first combiner network ground layer 323, a second prepreg 35 and a second dielectric layer 36 sandwiched between the first combiner network ground layer 323 and the combiner network layer 324, a third prepreg 37 and a third dielectric layer 38 sandwiched between the combiner network layer 324 and the second combiner network ground layer 325, a fourth prepreg 39 sandwiched between the second combiner network ground layer 325 and the surface-attached device ground layer 326, and a fourth dielectric layer 30 sandwiched between the surface-attached device ground layer 326 and the surface-attached device layer 327. Preferably, the first prepreg 33, the first dielectric layer 34, the second prepreg 35, the third prepreg 37, the fourth prepreg 39 and the fourth dielectric layer 30 all have a thickness of 0.1016 mm, and the second dielectric layer 36 and the third dielectric layer 38 both have a thickness of 0.254 mm.

Any one of a 2×2 array, a 4×4 array or an 8×8 array may be used in the phased array antenna 200. The phased array antenna 200 provided in the present disclosure is now described in detail in three specific modes of array: the 2×2 array, the 4×4 array and the 8×8 array.

Embodiment 1

Figure 4:
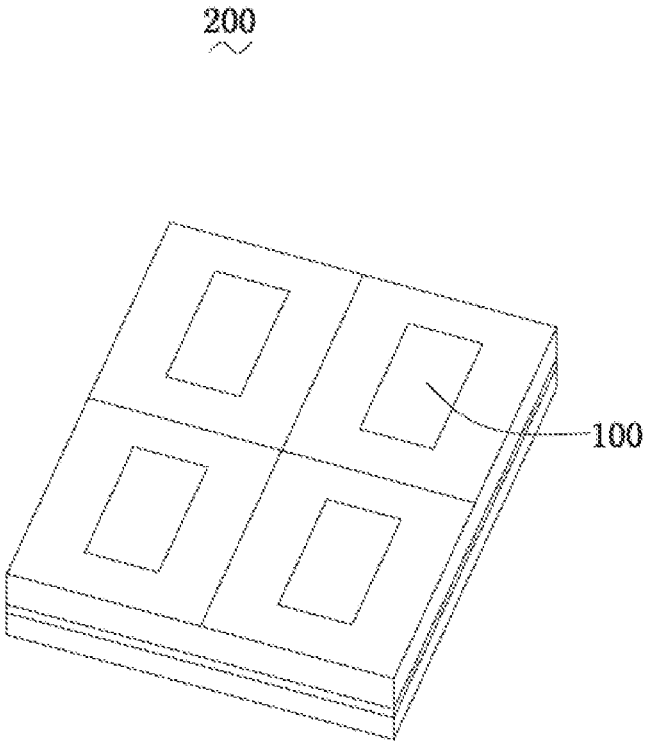
FIG. 4 is a schematic structural diagram of the phased array antenna using a 2×2 array provided in the present disclosure.
Figure 5:
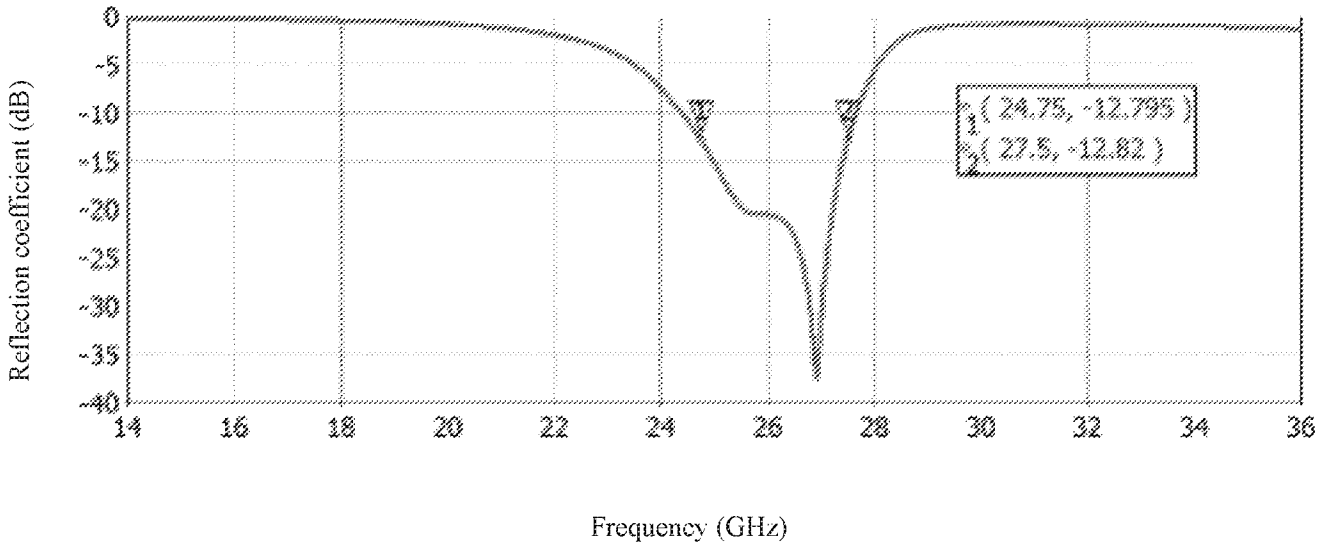
FIG. 5 is a reflection coefficient diagram of each antenna unit of the phased array antenna shown in FIG. 4.
Figure 6:
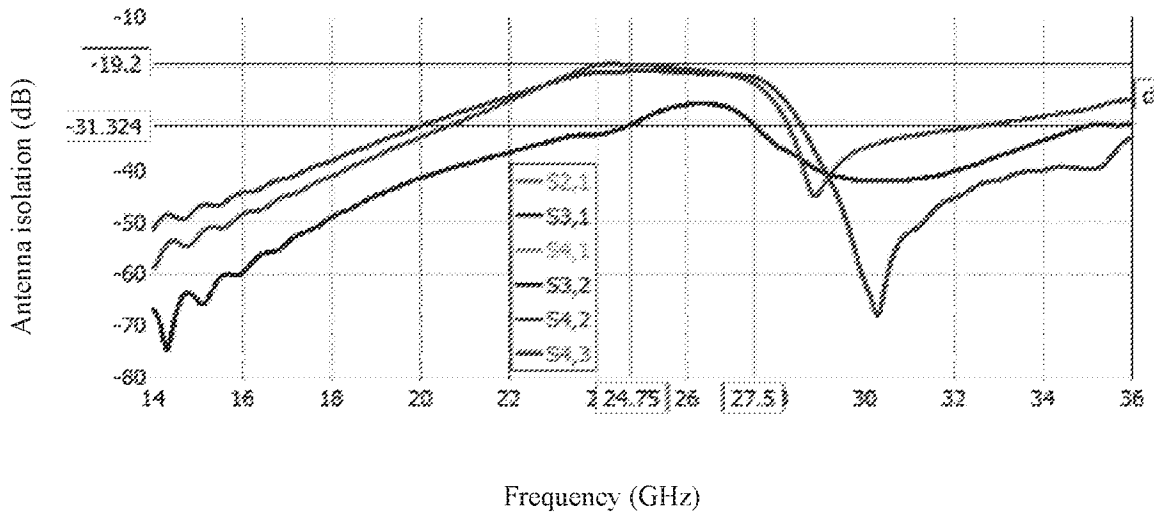
FIG. 6 is an isolation diagram between the antenna units of the phased array antenna shown in FIG. 4.
Figure 7:
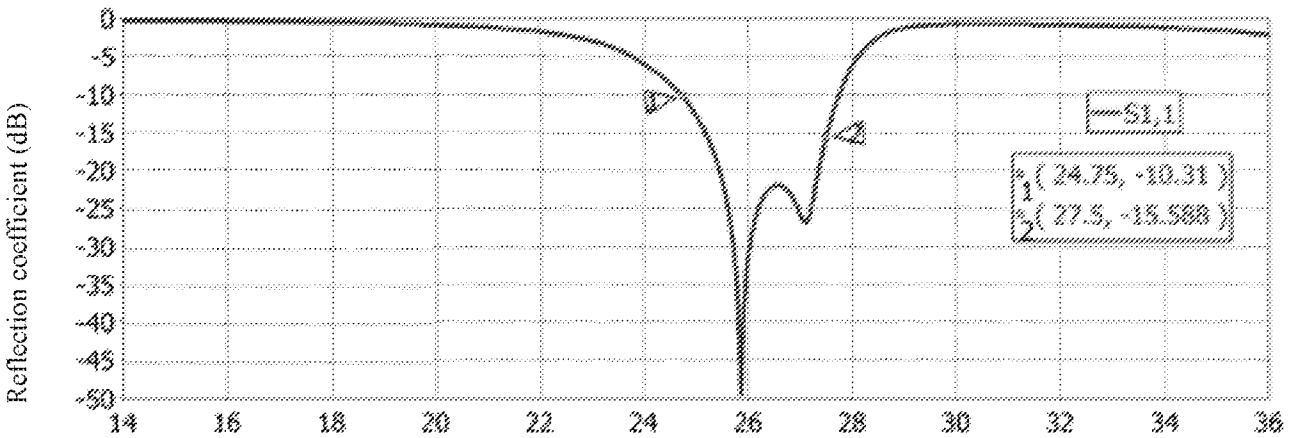
FIG. 7 is a reflection coefficient diagram of the phased array antenna shown in FIG. 4.
Figure 8:
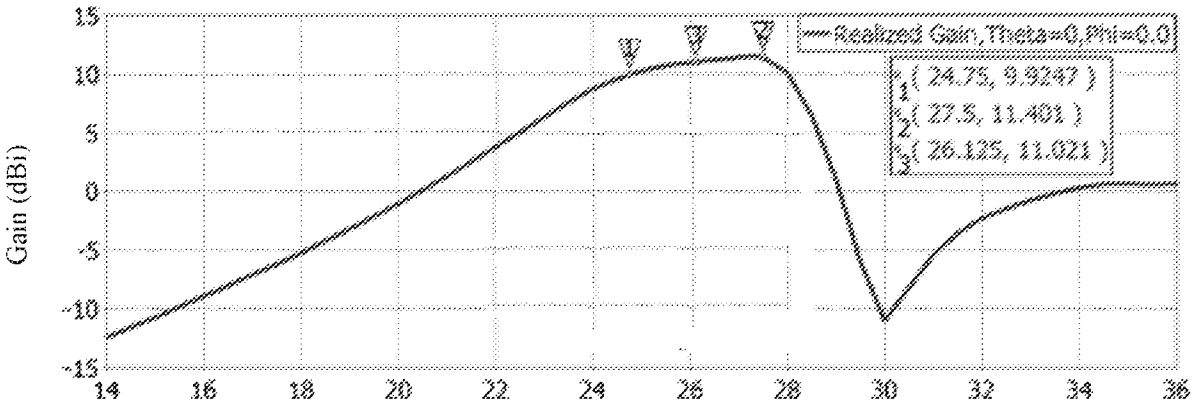
FIG. 8 is a gain diagram of the phased array antenna shown in FIG. 4.

The phased array antenna 200 using 2×2 array provided in the present disclosure is shown in FIG. 4, and with reference to FIG. 5 and FIG. 6, it can be seen that a single antenna unit 100 of the phased array antenna 200 has a reflection coefficient of less than −12 dB and an isolation of less than −19 db in a frequency band of 24.75 GHz to 27.5 GHz; and further with reference to FIG. 7 and FIG. 8, it can be seen that the phased array antenna 200 has a port reflection coefficient of less than −10 dB and a gain of more than 10 dB in a frequency band of 24.75 GHz to 27.5 GHz.

Embodiment 2

Figure 9:
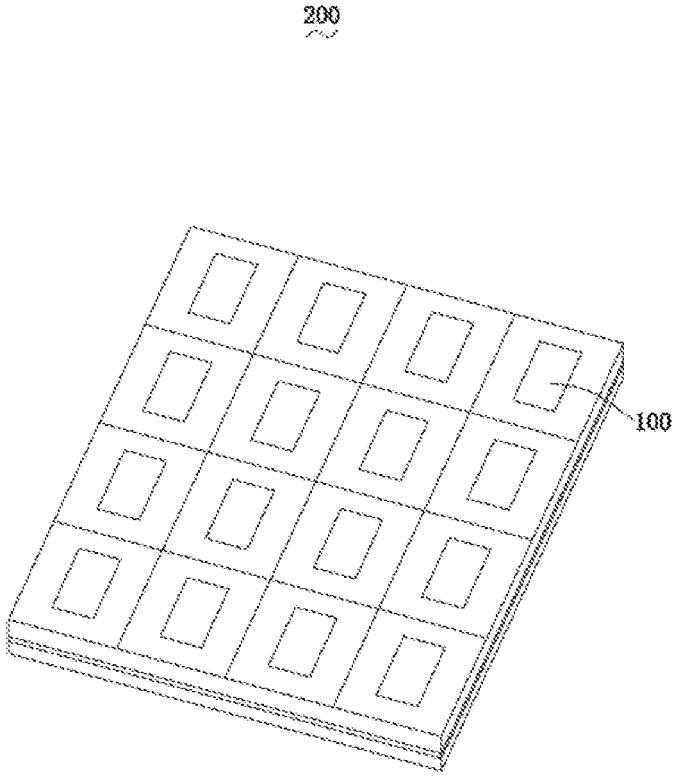
FIG. 9 is a schematic structural diagram of the phased array antenna using a 4×4 array provided in the present disclosure.
Figure 10:
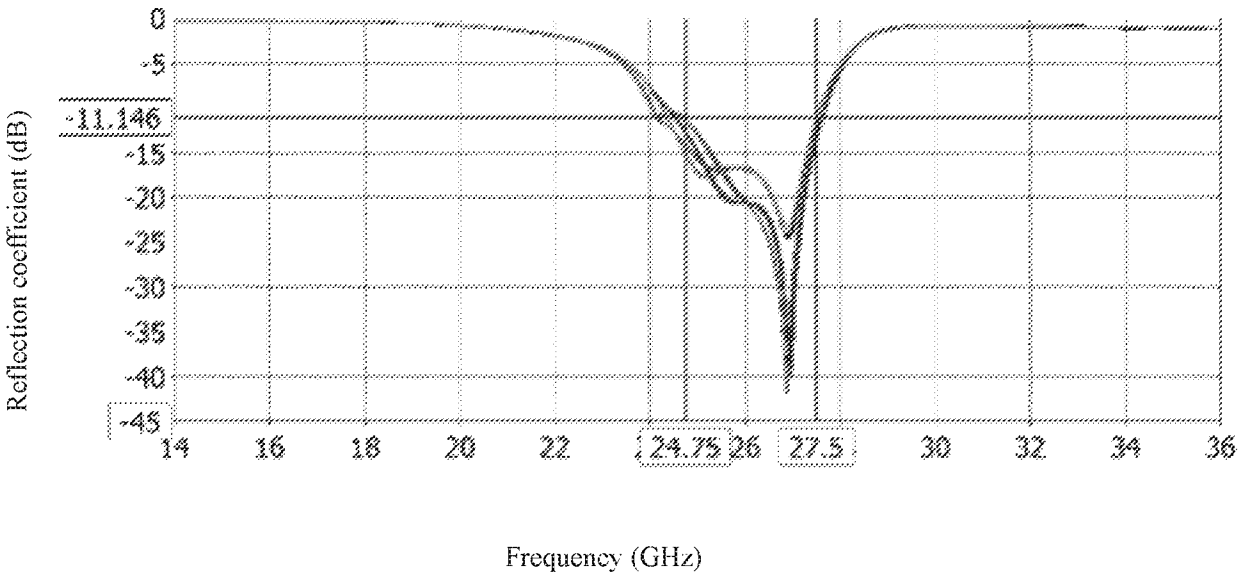
FIG. 10 is a reflection coefficient diagram of each antenna unit of the phased array antenna shown in FIG. 9.
Figure 11:
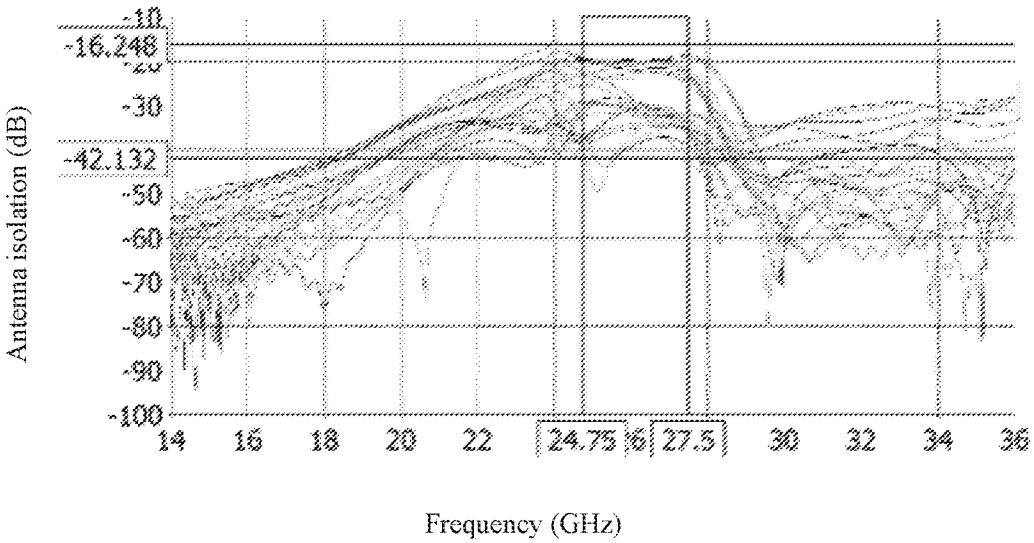
FIG. 11 is an isolation diagram between the antenna units of the phased array antenna shown in FIG. 9.
Figure 12:
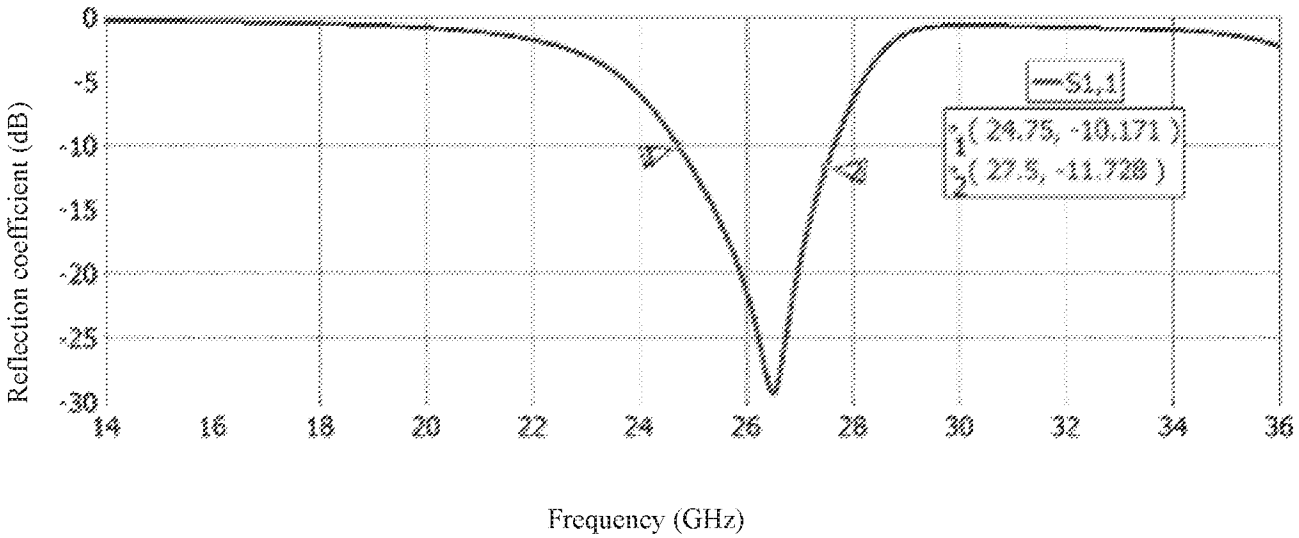
FIG. 12 is a reflection coefficient diagram of the phased array antenna shown in FIG. 9.
Figure 13:
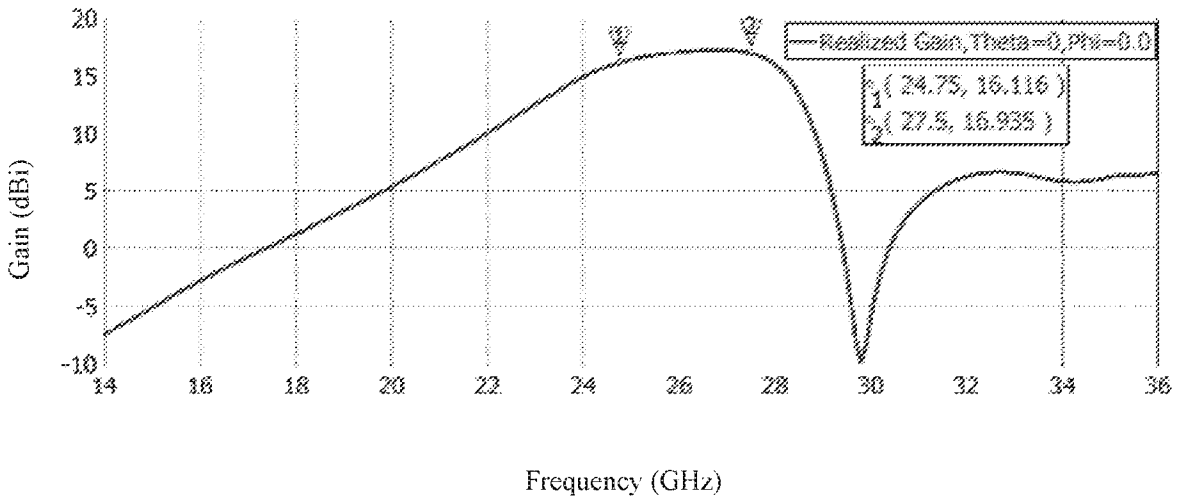
FIG. 13 is a gain diagram of the phased array antenna shown in FIG. 9.

The phased array antenna 200 using 4×4 array provided in the present disclosure is shown in FIG. 9, and with reference to FIG. 10 and FIG. 11, it can be seen that a single antenna unit 100 of the phased array antenna 200 has a reflection coefficient of less than −11 dB and an isolation of less than −18.6 dB in a frequency band of 24.75 GHz to 27.5 GHz; and further with reference to FIG. 12 and FIG. 13, it can be seen that the phased array antenna 200 has a port reflection coefficient of less than −11 dB and a gain of more than 16 dB in a frequency band of 24.75 GHz to 27.5 GHz.

Embodiment 3

Figure 14:
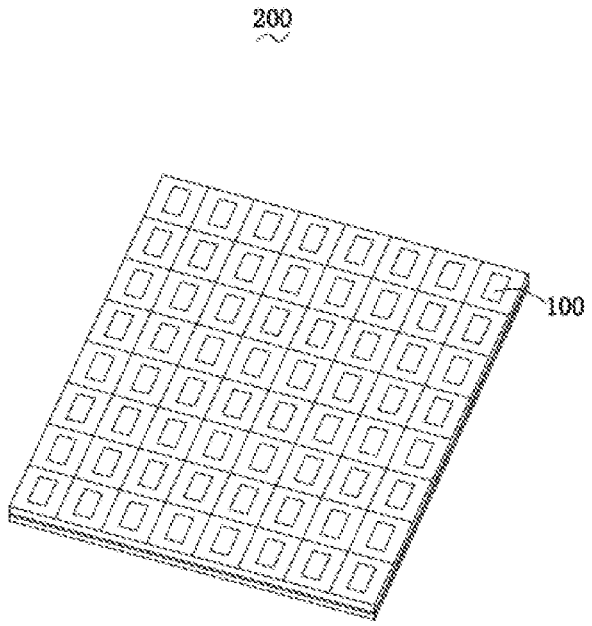
FIG. 14 is a schematic structural diagram of the phased array antenna using an 8×8 array provided in the present disclosure.
Figure 15:
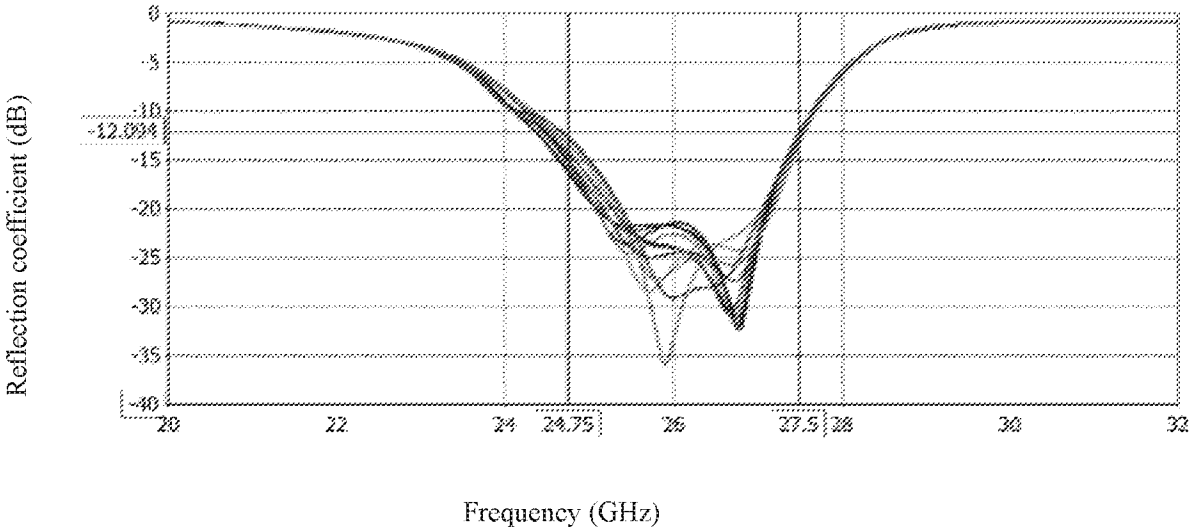
FIG. 15 is a reflection coefficient diagram of each antenna unit of the phased array antenna shown in FIG. 14.
Figure 16:
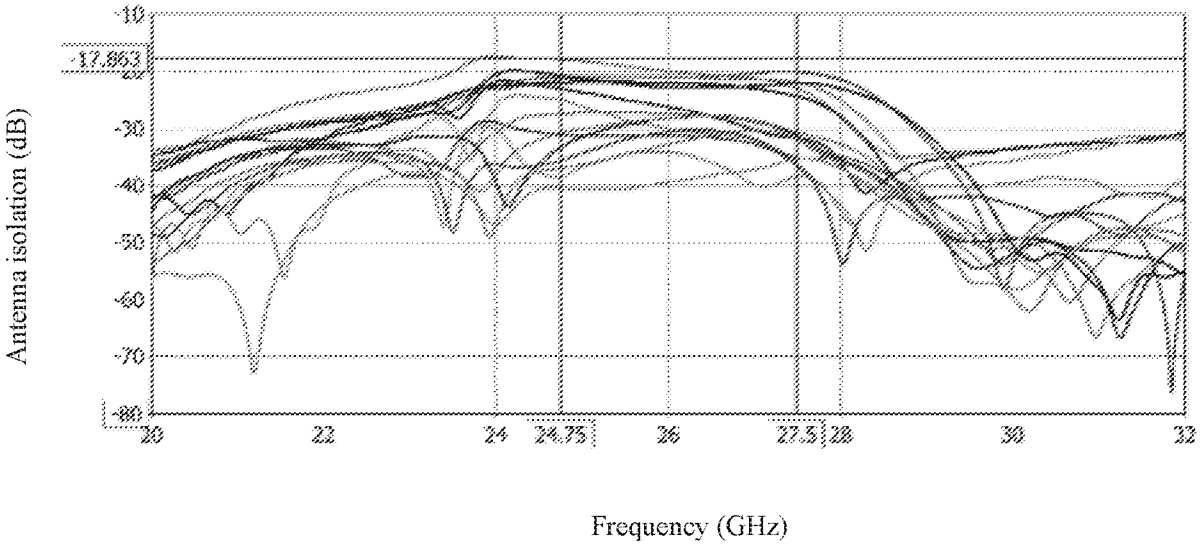
FIG. 16 is an isolation diagram between the antenna units of the phased array antenna shown in FIG. 14.
Figure 17:
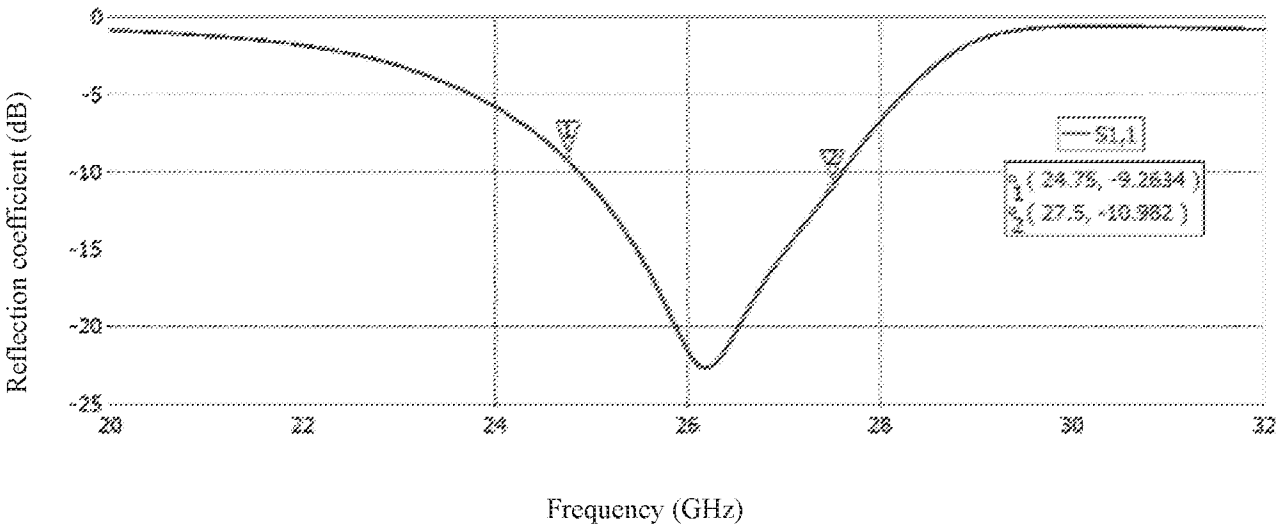
FIG. 17 is a reflection coefficient diagram of the phased array antenna shown in FIG. 14.
Figure 18:
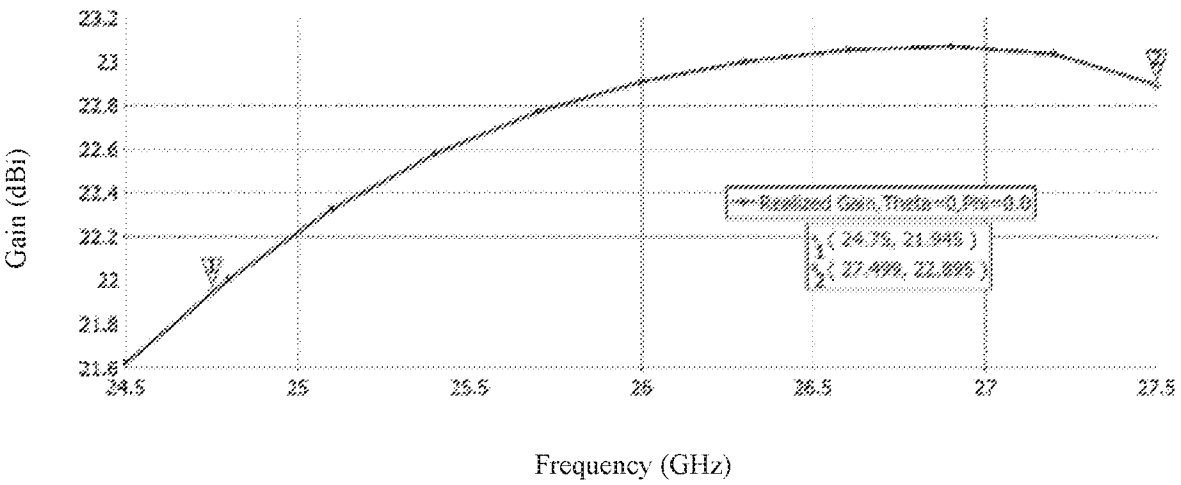
FIG. 18 is a gain diagram of the phased array antenna shown in FIG. 14.

The phased array antenna 200 using 8×8 array provided in the present disclosure is shown in FIG. 14, and with reference to FIG. 15 and FIG. 16, it can be seen that a single antenna unit 100 of the phased array antenna 200 has a reflection coefficient of less than −12 dB and an isolation of less than −17.8 dB in a frequency band of 24.75 GHz to 27.5 GHz; and further with reference to FIG. 17 and FIG. 18, it can be seen that the phased array antenna 200 has a port reflection coefficient of less than −10 dB and a gain of more than 23 dB in a frequency band of 24.75 GHz to 27.5 GHz.

Compared with related art, the phased array antenna provided in the present disclosure has the following beneficial effects: since an AIP-type vertically stacked structure is adopted, the phased array antenna has a thin overall thickness, a low reflection coefficient of the antenna units, and a high isolation between the antenna units, and can meet requirements of an indoor 5G communication base station.

The description above is merely embodiments of the present disclosure, and it should be pointed out that, those of ordinary skills in the art can make improvements without departing from the inventive concept of the present disclosure, but these all belong to the scope of protection of the present disclosure.

What is claimed is:

1. A phased array antenna, comprising a core board, as well as an antenna module and a radio frequency module respectively arranged at two sides of the core board, wherein the radio frequency module comprises a device and a circuit layer electrically connected to the device, and the device and the circuit layer at least form a phase control unit to control a phase of each antenna unit in the antenna module, the circuit layer comprises a control line layer, a power supply layer, a first combiner network ground layer, a combiner network layer, a second combiner network ground layer, a surface-attached device ground layer and a surface-attached device layer sequentially arranged at intervals from top to bottom, and the device at least comprises a storage unit, a RFIC chip and a plug which are arranged on the surface-attached device layer.

2. The phased array antenna according to claim 1, wherein the storage unit comprises a first storage unit and a second storage unit, the first storage unit, the RFIC chip and the second storage unit are all electrically connected to the surface-attached device layer, the control line layer and the surface-attached device ground layer are both electrically connected to the first storage unit via the surface-attached device layer, the antenna module, the control line layer and the combiner network layer are electrically connected to the RFIC chip respectively, the combiner network layer is electrically connected to the plug, and the power supply layer and the surface-attached device ground layer are electrically connected to the second storage unit via the surface-attached device layer respectively.

3. The phased array antenna according to claim 2, wherein the radio frequency module further comprises a first prepreg sandwiched between the control line layer and the power supply layer, a first dielectric layer sandwiched between the power supply layer and the first combiner network ground layer, a second prepreg and a second dielectric layer sandwiched between the first combiner network ground layer and the combiner network layer, a third prepreg and a third dielectric layer sandwiched between the combiner network layer and the second combiner network ground layer, a fourth prepreg sandwiched between the second combiner network ground layer and the surface-attached device ground layer, and a fourth dielectric layer sandwiched between the surface-attached device ground layer and the surface-attached device layer.

4. The phased array antenna according to claim 3, wherein the first prepreg, the first dielectric layer, the second prepreg, the third prepreg, the fourth prepreg and the fourth dielectric layer all have a thickness of 0.1016 mm, and the second dielectric layer and the third dielectric layer both have a thickness of 0.254 mm.

5. The phased array antenna according to claim 1, wherein the core board has a thickness of 0.3 mm.

6. The phased array antenna according to claim 1, wherein the control line layer, the power supply layer, the first combiner network ground layer, the combiner network layer, the second combiner network ground layer, the surface-attached device ground layer and the surface-attached device layer are all copper layers.

7. The phased array antenna according to claim 2, wherein the first storage unit and the second storage unit are both MLC.

8. The phased array antenna according to claim 1, wherein any one of a 2×2 array, a 4×4 array or an 8×8 array is used in the phased array antenna.

* * * * *